US006890286B2

(12) United States Patent
Pan

(10) Patent No.: US 6,890,286 B2
(45) Date of Patent: May 10, 2005

(54) CONTROL DEVICE FOR A TREADMILL HAVING A DUAL-PURPOSE ELECTRONIC ELEMENT

(75) Inventor: Francis Pan, Taichung Hsien (TW)

(73) Assignee: Forhouse Corporation, Taichung Hsien (TW)

( * ) Notice: Subject to any disclaimer, the term of this patent is extended or adjusted under 35 U.S.C. 154(b) by 246 days.

(21) Appl. No.: 10/145,368

(22) Filed: May 14, 2002

(65) Prior Publication Data

US 2003/0216225 A1 Nov. 20, 2003

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,476,430 A * 12/1995 Lee et al. ..... 482/54
5,682,327 A * 10/1997 Telepko ..... 601/34
6,436,008 B1 * 8/2002 Skowronski et al. ..... 482/54

* cited by examiner

*Primary Examiner*—Glenn E. Richman
(74) *Attorney, Agent, or Firm*—Head, Johnson & Kachigian

(57) ABSTRACT

A control device for a treadmill having a dual-purpose electronic element having a panel and a control circuit formed in the panel. The control circuit basically includes a controller, driving unit connected between the controller and a motor and a speed control and switch unit connected between the controller and the driving unit. The speed control and switch unit has at least two functions which are adjusting the speed of the motor and immediately stopping the rotation of the motor. Therefore the control device not only saves at least one electronic element for the control circuit but the panel has more space.

12 Claims, 12 Drawing Sheets

CONTROL DEVICE FOR A TREADMILL HAVING A DUAL-PURPOSE ELECTRONIC ELEMENT

BACKGROUND OF THE INVENTION

1. Field of the Invention

The present invention relates to a control device for a treadmill, and more particularly to a control device that uses a dual-purpose electronic element to conveniently adjust the speed of a treadmill and can immediately stop the operation of the treadmill.

2. Description of Related Art

Modern treadmills have a panel with a control circuit to make many capabilities available to a user. The control circuit is formed on a printed circuit board mounted in the panel. The printed circuit board uses many electronic elements to control the functions of the control circuit. Some of the electronic elements are buttons and knobs. Buttons extend out of the panel so a user can control power to the treadmill, display specific information, set or adjust operational modes, etc. A knob extends out of the panel to turn a rheostat in the control circuit to adjust the speed of the treadmill.

Most new electronic devices have more and more functions to attract consumers. More buttons and knobs are used on the panel of the treadmill to accommodate the additional electronic elements on the printed circuit board. As the panel becomes more populated with buttons, knobs, switches, indicators, displays, etc., pressing a specific button or turning a specific knob without inadvertently moving some other button or knob is difficult, especially when a user is running or walking on the treadmill.

To overcome the shortcomings, the present invention provides an improved control device for a treadmill to mitigate and obviate the aforementioned problems.

SUMMARY OF THE INVENTION

The main objective of the invention is to provide a control device for a treadmill having a dual-purpose electronic element to save some electronic elements that are used on a printed circuit board on which the control circuit is formed.

Another objective is to provide a control device with a dual-purpose electronic element that can easily control the speed of the treadmill or immediately stop the operation of the treadmill.

Another objective is to save space on the panel through use of the dual-purpose electronic element.

Other objectives, advantages and novel features of the invention will become more apparent from the following detailed description when taken in conjunction with the accompanying drawings.

BRIEF DESCRIPTION OF THE DRAWINGS

FIGS. 1A to 1I are circuit diagrams of a control circuit for a treadmill in accordance with the present invention;

DETAILED DESCRIPTION OF THE PREFERRED EMBODIMENT

Figure 1A:
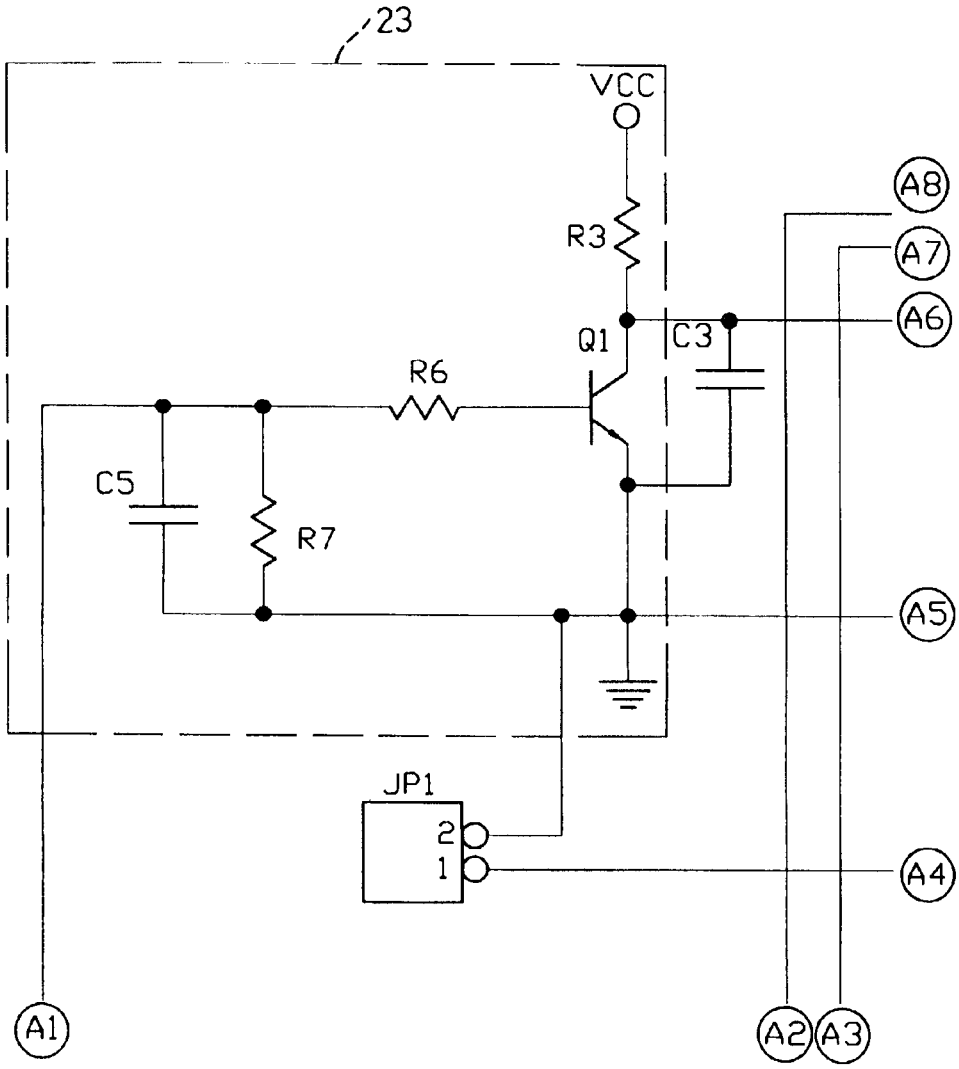
Figure 1B:
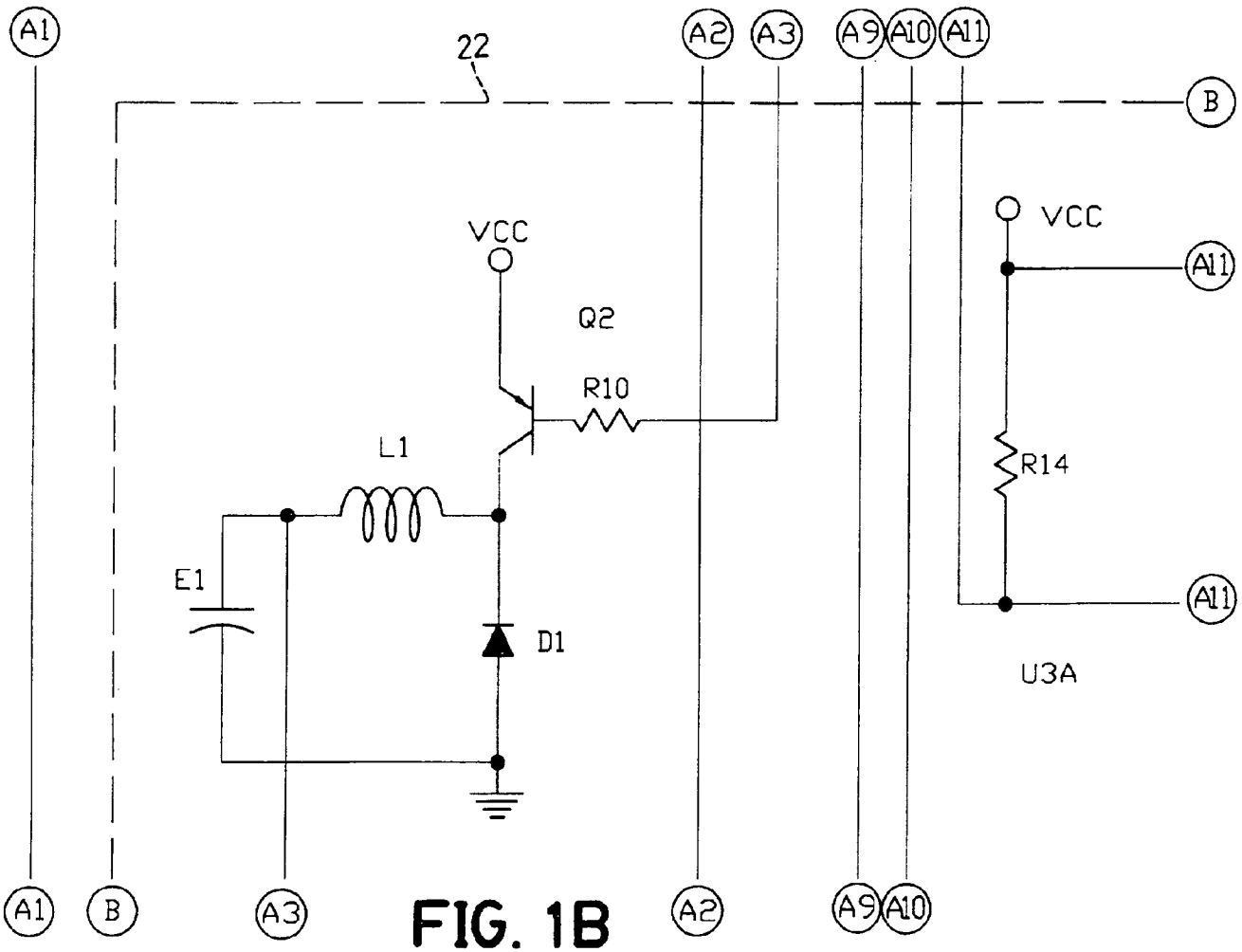
Figure 1C:
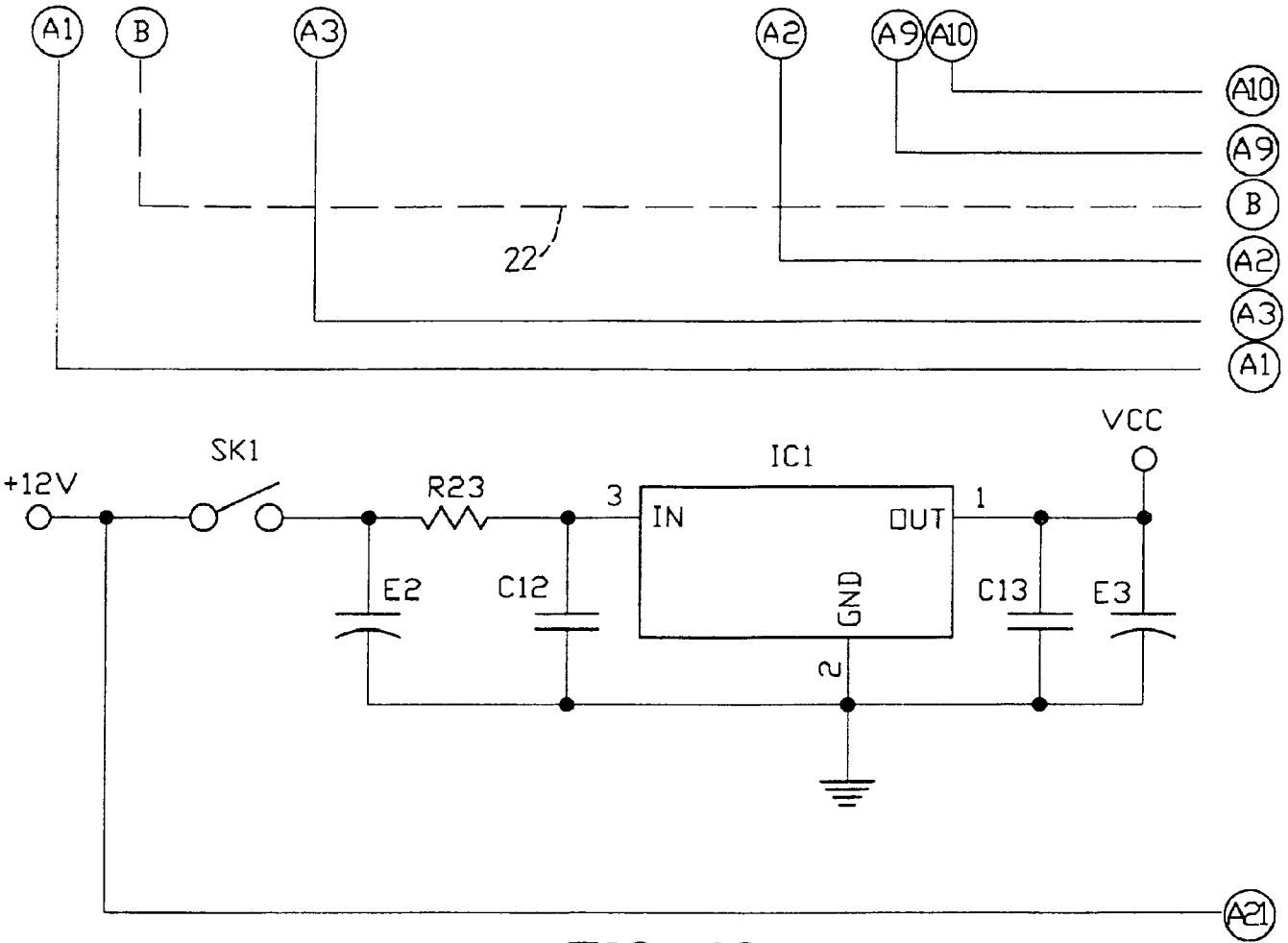
Figure 1D:
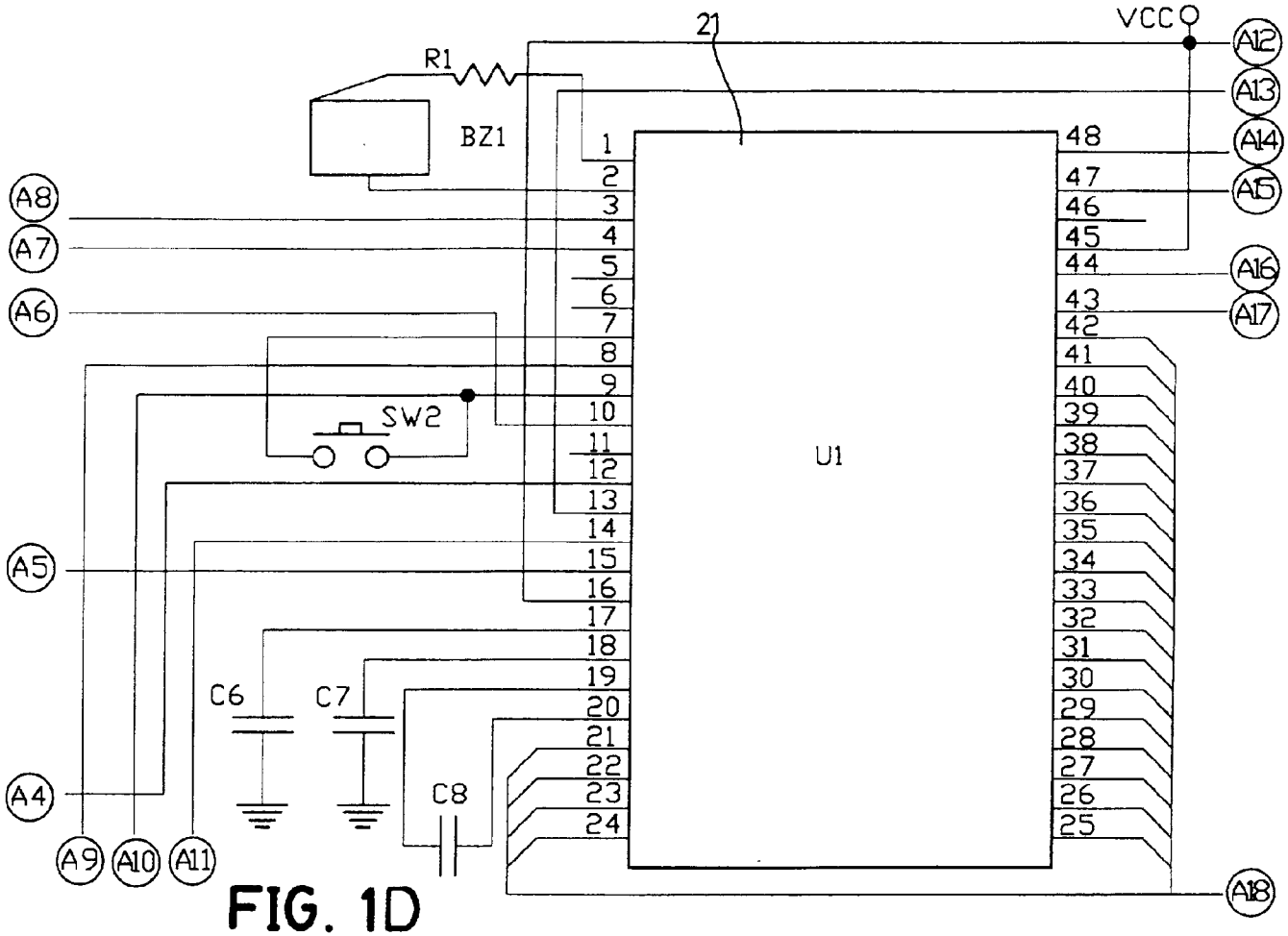
Figure 1E:
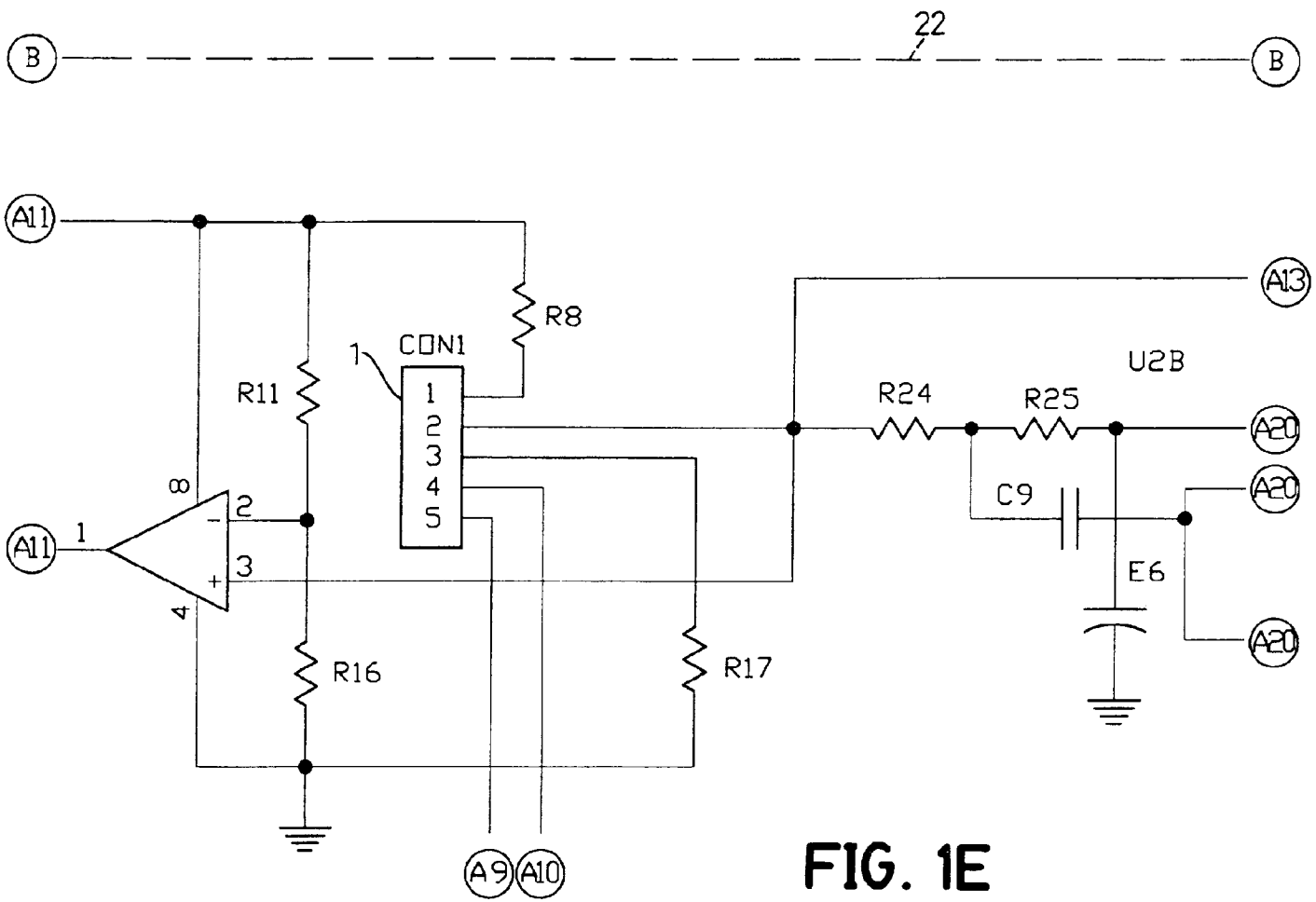
Figure 1F:
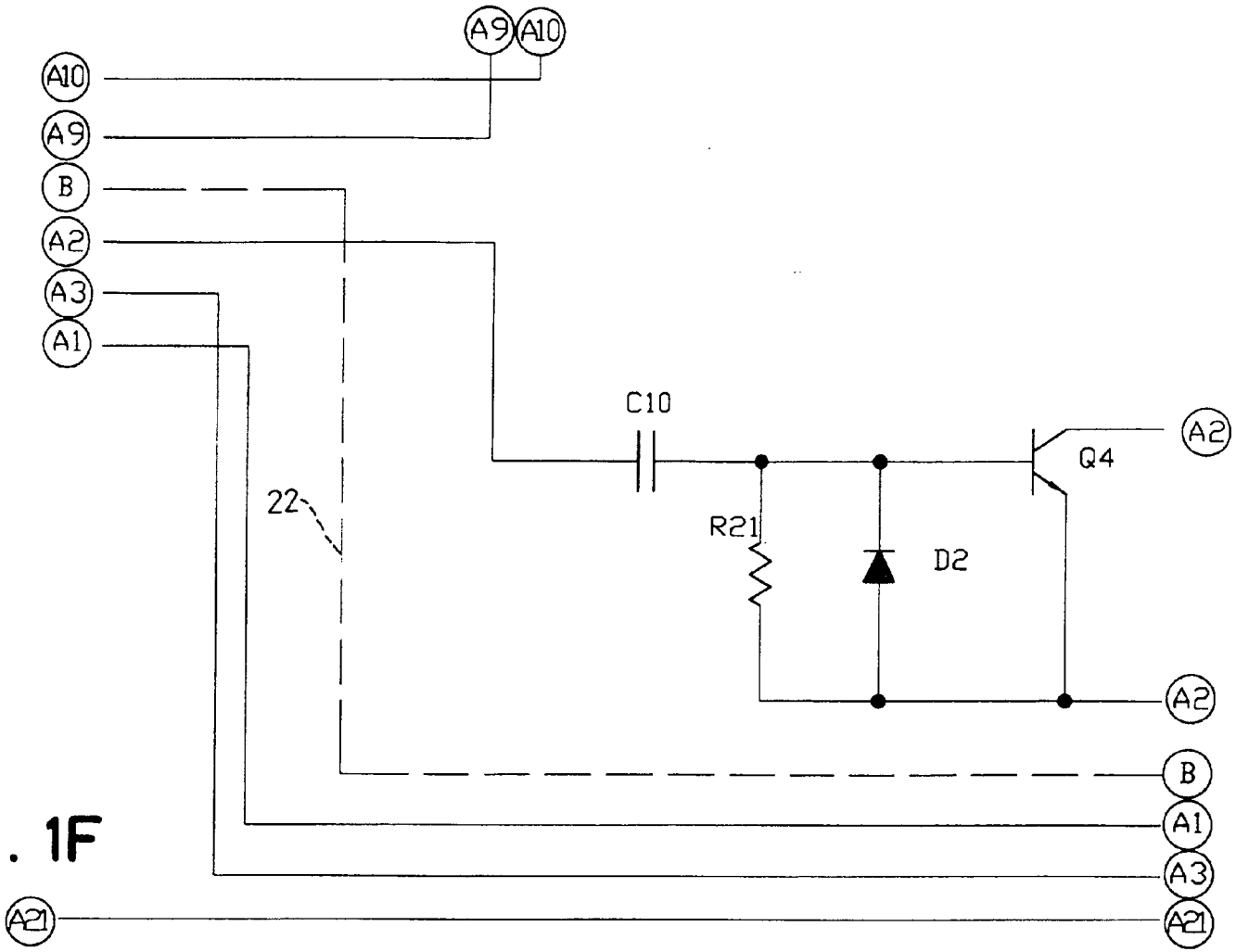
Figure 1G:
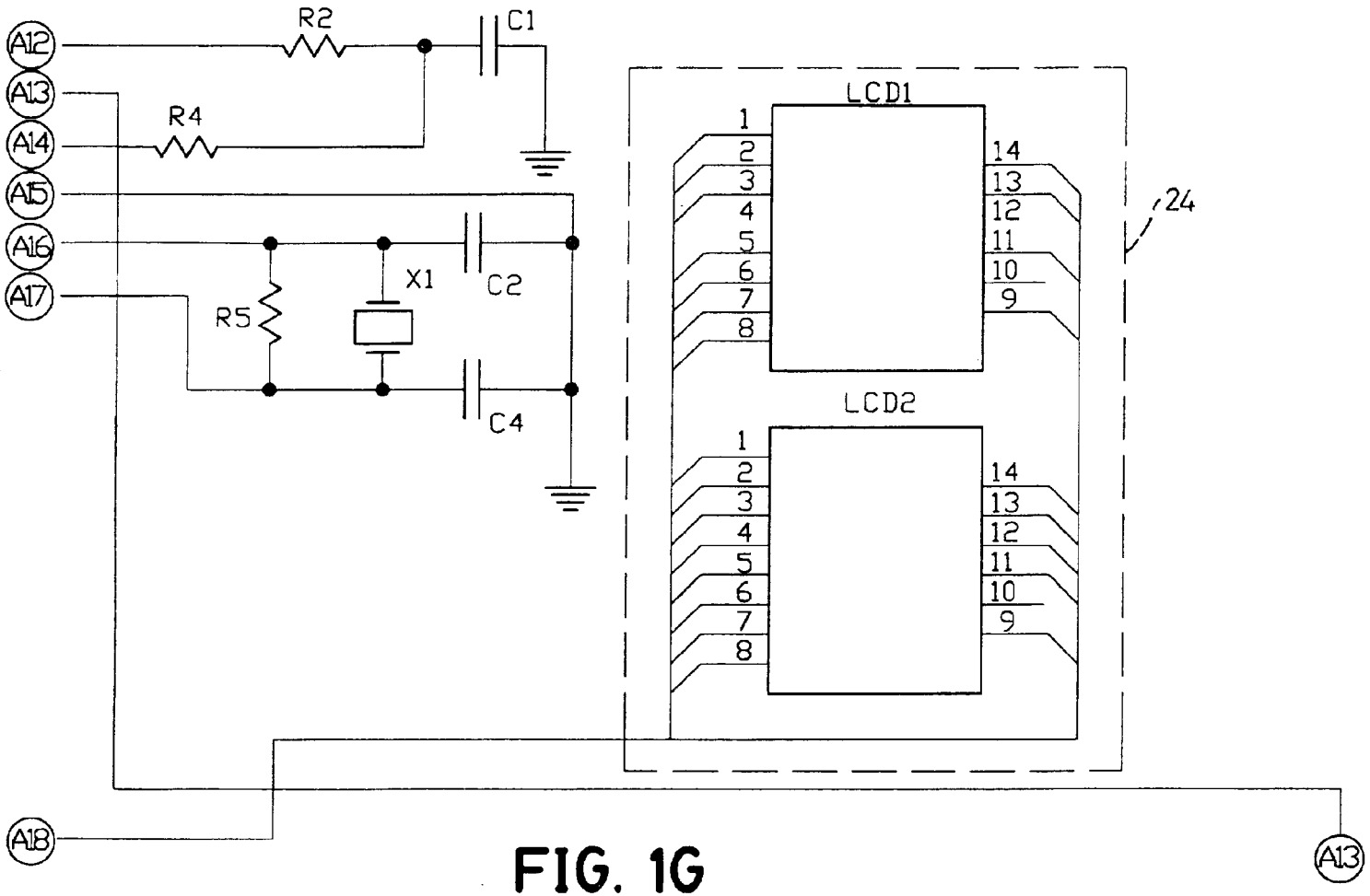
Figure 1H:
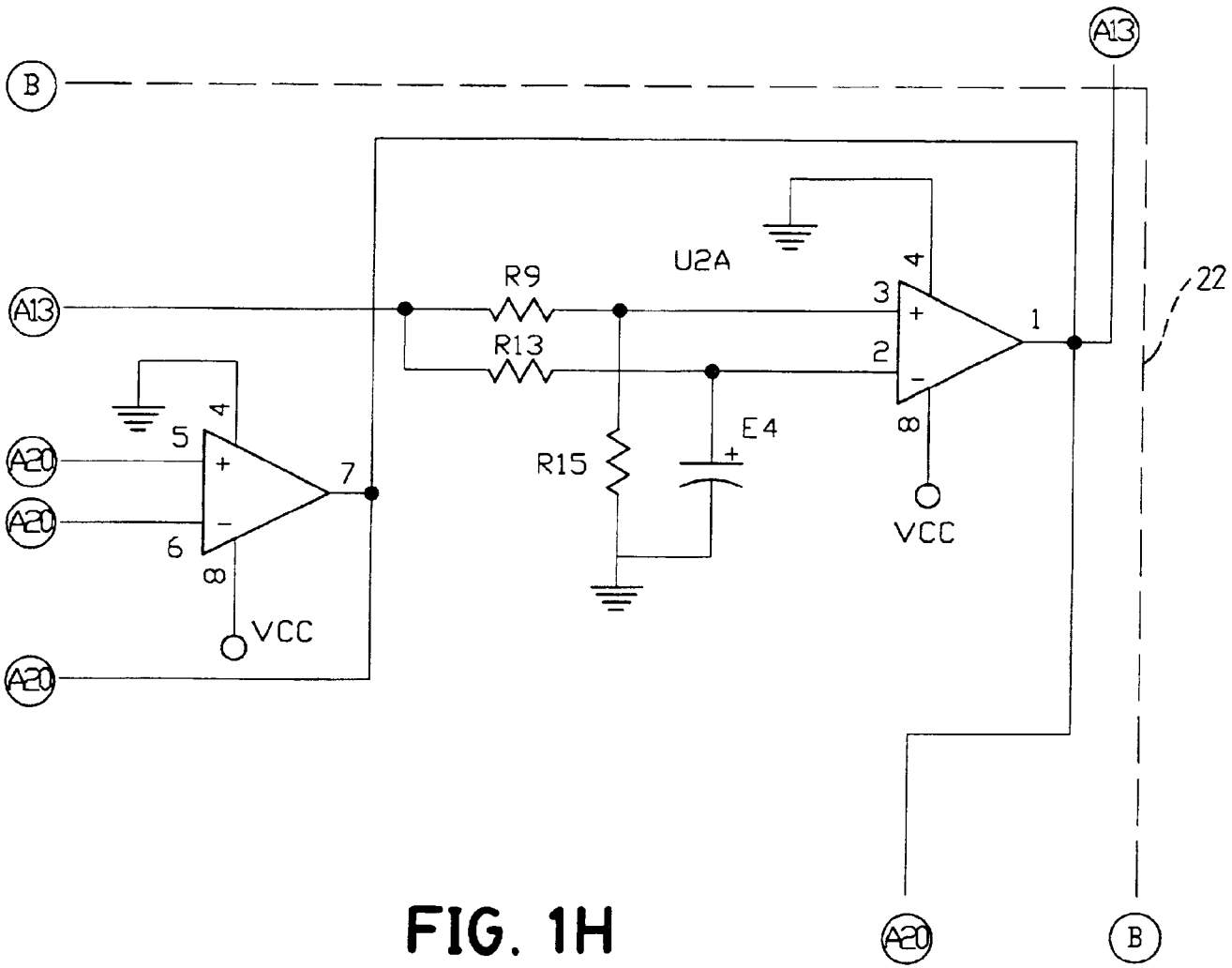
Figure 11:
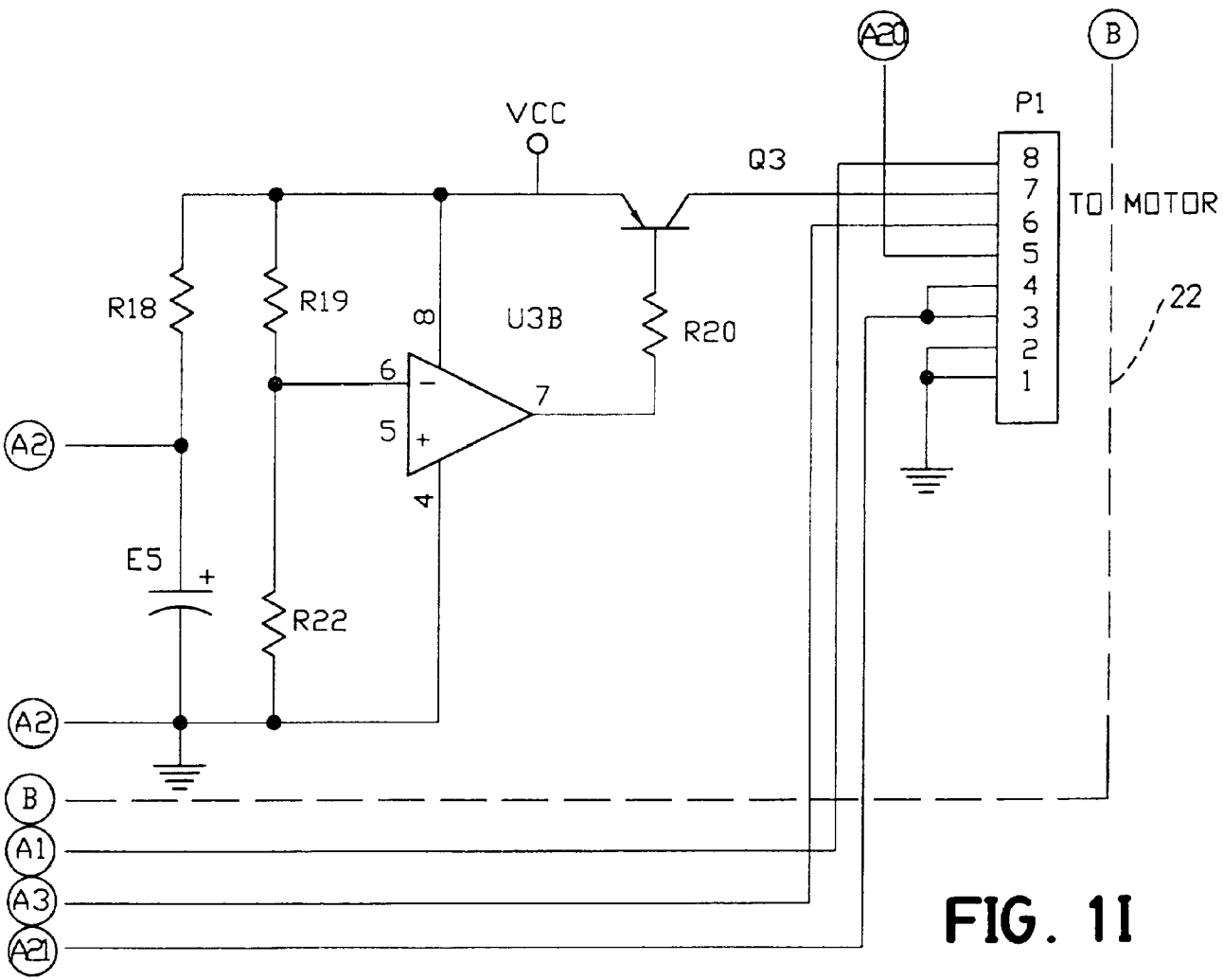

A control circuit of a treadmill can control lots of functions, such as changing the speed of the tread, stopping the tread, turning power to the treadmill on or off, displaying tread speed, etc. With reference to FIG. 1A to 1I, the control circuit comprises a main controller (21), a driving unit (22), a detector (23), at least one display (24), a speed control and stop unit (1).

The controller (21) is a microprocessor (U1) having multiple input terminals and the output terminals.

The driving unit (22) is connected between the controller and a motor (not shown) through a connector (P1) to control the speed of the motor when the controller (21) outputs a control signal to the driving unit (22).

The detector (23) connects between the controller (21) and a motor to detect the speed of the motor and then output a detecting signal to the controller (21).

The speed control and switch unit (1) has at least five terminals including two switch terminals (4,5) and three terminals (1,2,3) for a rheostat. That is, the speed control and switch unit (1) is a dual-purpose electronic element having a pushbutton and a rheostat. The two switching terminals (4,5) are connected the one input and one output terminals (8,9) of the controller (21). In normal state, the two switch terminals (4,5) are open and the input terminal (9) do not get signal from the output terminal (8). When the pushbutton is pressed, the two switch terminals (4,5) are closed, so that the input terminal (9) is short to the output terminal (8) and then get a signal from the output terminal (8). The controller (21) control the motor to stop running through the driving unit (22). The switching terminals are also to be other functions in the circuit like power switch or display switch etc.

The display (24) is connected to the output terminals of the controller (21) to display information from the treadmill like speed, running time, etc.

Figure 2:
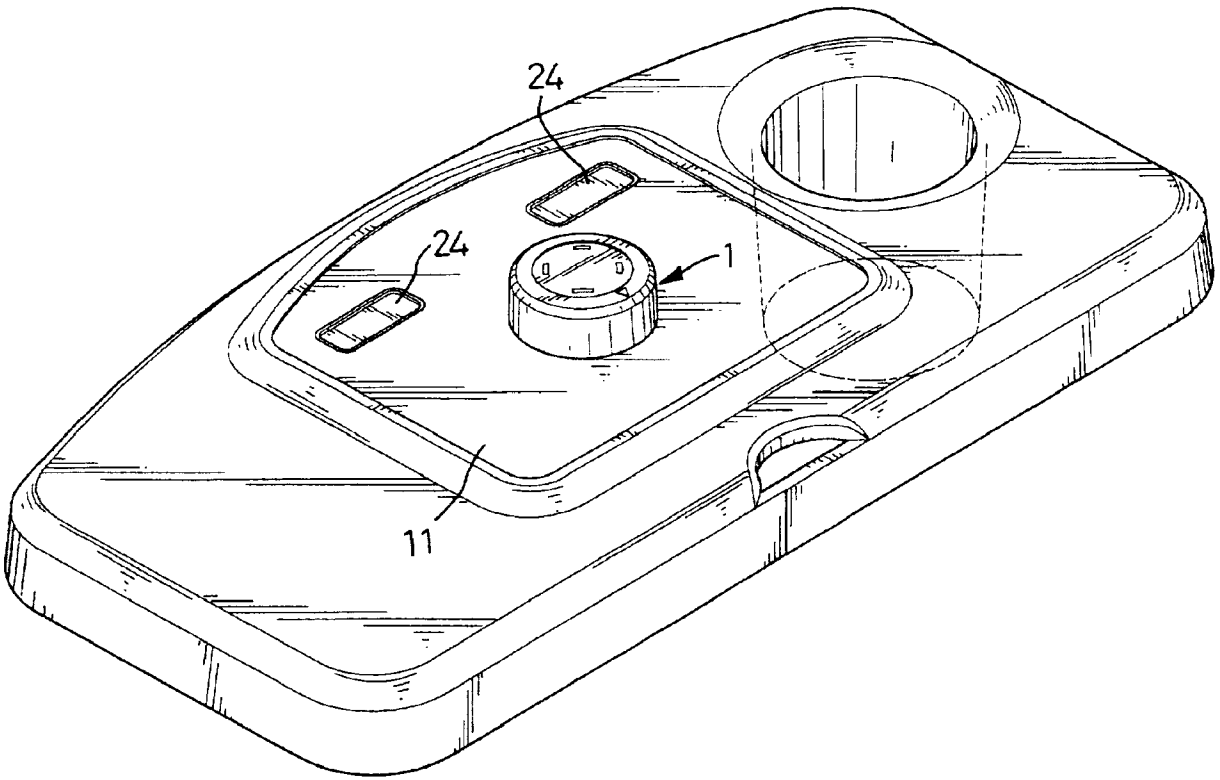
FIG. 2 is a perspective view of a panel including a dual-purpose electronic element for a control circuit of a treadmill in accordance with the present invention.

With reference to the FIG. 2, the foregoing control circuit is formed on a printed circuit board (not shown) in a panel (11). The speed control and switch unit (1) extends out from the panel (11) and the displays (24) are visible through the panel (11).

Figure 3:
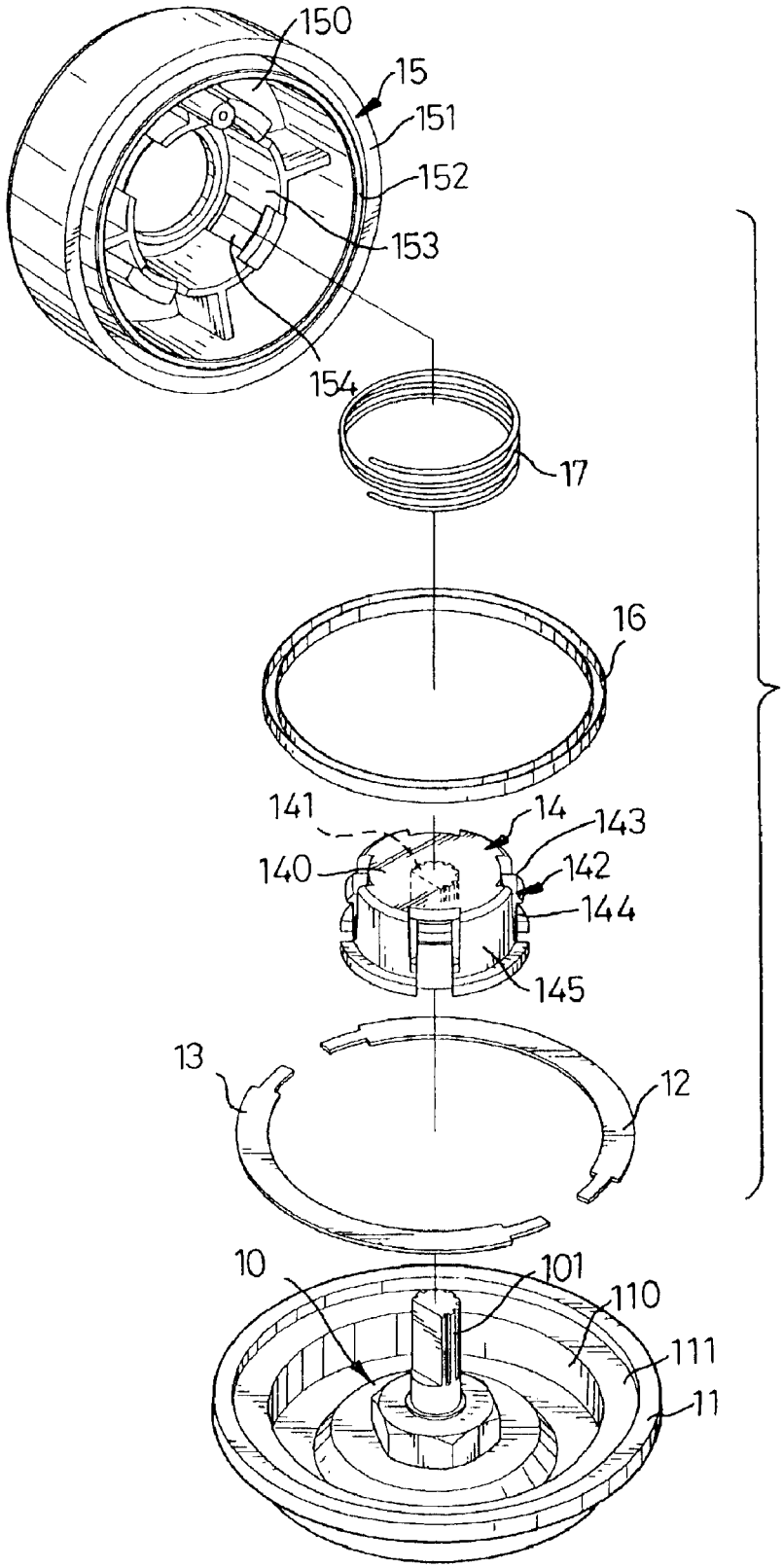
FIG. 3 is an exploded perspective view of the dual-purpose electronic element in FIG. 2.

With reference to FIG. 3, the speed control and switch unit (1) comprises a rheostat (10) having a rotating shaft (101) and a knob (not numbered) mounted on the rotating shaft (101) to easily adjust the rheostat (10). The knob mounted on the panel (11) comprises arcuate contacts (12,13), a hub (14) with a positioning device, a pushbutton cap (15), a conductive arc (16) and a biasing member.

Figure 4:
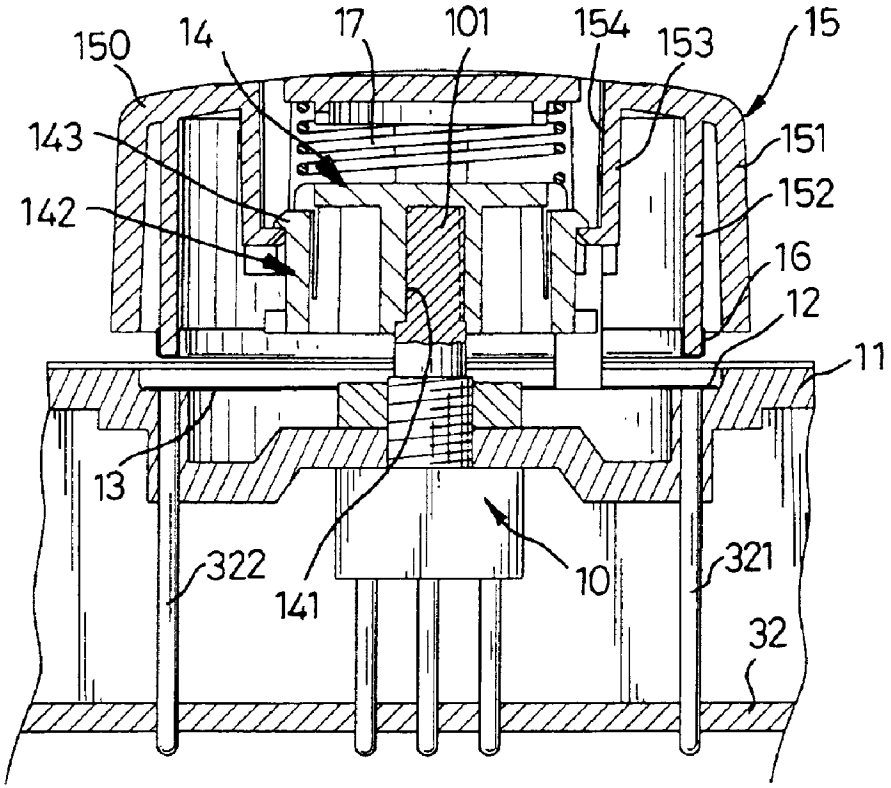
FIG. 4 is a side plan view in partial section of the dual-purpose electronic element in FIG. 2 and a portion of the panel in FIG. 3 and a printed circuit board in accordance with the present invention.

Referring to FIGS. 3 and 4, the arcuate contacts (12, 13) are mounted on the panel (11) separate from each other. The arcuate contacts (12,13) respectively are connected to the printed circuit board through two conductive tabs (321,322). The two arcuate contacts (12,13) are the switch terminals of the control circuit. The hub (14) is securely mounted on the rotating shaft (101) to turn the shaft (101) to adjust the resistance of the rheostat (10). The pushbutton cap (15) has a bottom edge (not numbered). A conductive arc (16) corresponding to the arcuate contacts (12,13) on the panel (11) is connected to the bottom edge of the pushbutton cap (15). The biasing member is mounted in the pushbutton cap (15) between the pushbutton cap (15) and the hub (14) or the panel (11) to press the pushbutton cap (15) away from the panel (11) when downward pressure on the pushbutton cap (15) is released. When the pushbutton cap (15) is pressed toward the panel (11), the conductive arc (16) touches the arcuate contacts (12,13) to make the two conductive tabs electrically connect together and close the circuit between ground and the controller of the control circuit. When pressure on the pushbutton cap (15) is released, the conductive arc (16) separates from the arcuate contacts (12,13), and the circuit between the conductive arcs (12,13) is opened. To attain the function, the pushbutton cap (15) is able to be designed to an arcuate conductive contact (not shown) corresponded to one arcuate contact (12). That is the other arcuate contact (13) is replaced to the arcuate conductive contact. Therefore the arcuate contacts (12) mounted on the panel (11) only needs one.

A chamber (110) is defined in the panel (11) and communicates with a through hole (not numbered) in the panel (11). An opening (not numbered) having a bigger diameter than the chamber (110) is defined in the panel (11) to form a shoulder (111) in the chamber (110) of the panel (11) to on which the two arcuate contacts (12, 13) mounted securely.

The hub (14) includes a top (140) having a bottom face (not numbered), an integral skirt (145) formed around the top (140) and extending down and a central keyed tube (141) formed on and extending down from the bottom face. Multiple L-shaped resilience keys (142) extend radially out from the skirt (145) of the hub (14). Each key (142) has a radial tab (143) and a longitudinal leg (144) on which the radial tab (143) is formed. The tube (141) has a sawtooth pattern on the inner face to securely hold the rotating shaft (101).

The pushbutton cap (15) has a top (150) with an outer edge, a center, a bottom face (not numbered) and at least one skirt formed on and extending down from the bottom face of the top (150). In the preferred embodiment, there are three different diameter concentric circular skirts (151, 152, 153). An exterior skirt (151), a contact skirt (152) and a locking skirt (153) are sequentially and concentrically formed on the bottom face of the top (150) from the outer edge toward the center. The contact skirt (152) is longer than the others and has a bottom edge to which the conductive arc (16) connects. The hub (14) is slidably mounted in the locking skirt (153). The locking skirt (153) has an inner surface (not numbered). Multiple longitudinal recesses (154) corresponding to the radial tabs (143) of the keys (142) are defined in the inner surface of the locking skirt (153).That is, the positioning device between the pushbutton cap (15) and the hub (14) includes the resilient keys (142) on the hub (14) and the recesses (154) in the locking skirt (153) of the pushbutton cap (15).

The biasing member is a spring (17) or a pair of magnets (not shown). The spring (17) is mounted inside the circular locking skirt (151). When assembling the panel (11), the hub (14) and the pushbutton cap (15), the spring (17) is mounted between the hub (14) and the pushbutton cap (15).

The control circuit uses the dual-purpose electronic element on the printed circuit board as the speed control and switch unit that allows the user to adjust the tread speed by changing the resistance of the rheostat or to immediately stop the motor by pressing the knob. That is, turning the pushbutton cap changes the resistance of the rheostat to adjust the speed of the tread. When the knob is pressed toward the panel, the conductive arc and the arcuate contacts make contact. Therefore the speed control and switch unit is a dual-purpose electronic element having two functions so that the control circuit is able to use fewer electronic elements. The number of knobs and buttons on the panel are decreased.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A control device having a dual-purpose electronic element for a treadmill, said device comprising:

a panel and a control circuit formed on a printed circuit board in the panel, wherein the control circuit includes a controller having multiple input terminals and output terminals, wherein the output terminals are connected to a driving unit for controlling speed of a motor, and the controller controlling the speed of the motor through the driving unit; and a speed control and switch unit connected to the controller whereby manipulating the speed control and switch unit easily controls the speed of the motor, wherein the speed control and switch unit having at least five terminals formed on the printed circuit board, the speed control and switch unit further including;

a rheostat having a rotating shaft extending out of the panel, at least one contact mounted on the panel, a hub connected to the rotating shaft and having a top and a first skirt integrally extending downward from the top with a positioning device, a pushbutton cap having a top and at least one second skirt corresponding to the positioning device on the first skirt on the hub to slide up and down the first skirt of the hub, wherein the at least one second skirt has a bottom edge on which a conductive arc corresponding to the at least one contact is mounted, and a biasing member mounted in the pushbutton cap to provide a restitution force to the cap, wherein the pushbutton cap returns to an original position relative to the hub when pressure on the pushbutton cap is released and breaks contact between the at least one contact on the panel and the conductive arc.

2. The control device as claimed in claim 1 further including, a detector connected to the input terminal of said controller and said motor to detect the speed of said motor and then output a detecting signal to said controller; and at least one display connected to the output terminals of said controller to display information from said controller.

3. The control device as claimed in claim 1 wherein said positioning device includes, multiple L-shaped resilience keys extending radially outward from said first skirt of said hub, wherein each key has a radial tab and a longitudinal leg; and multiple longitudinal recesses corresponding to the radial tabs of the keys and defined on an inside surface of said at least one second skirt of said pushbutton cap.

4. The control device as claimed in claim 1 wherein a tube having an inner face is integrally formed down from said top of said hub to hold said rotating shaft.

5. The control device as claimed in claim 4, wherein a sawtooth pattern is formed on the inner face of said tube to securely hold said rotating shaft.

6. The control device as claimed in claim 1 wherein said pushbutton cap includes three different diameter concentric circular second skirts respectively formed on the top, wherein said conductive arc is mounted on the smallest diameter circular second skirt that is longer than the others to easily touch the contacts on said panel.

7. The control device as claimed in claim 1 wherein said biasing member is a spring mounted between said pushbutton cap and said hub.

8. A control device having a dual-purpose electronic element for a treadmill, said device comprising:

a panel and a control circuit formed on a printed circuit board in the panel, wherein the control circuit includes a controller having multiple input terminals and output terminals, the output terminals are connected to a driving unit for controlling speed of a motor, and the controller controlling the speed of the motor through the driving unit;

a detector connected to the input terminal of the controller and the motor to detect the speed of the motor and then output a detecting signal to the controller;

at least one display connected to the output terminals of the controller to display information from the controller; and a speed control and switch unit connected to the controller whereby manipulating the speed control and switch unit easily controls the speed of the motor, the speed control and switch has at least five terminals formed on the print circuit board and further includes;

a rheostat having a rotating shaft extending out of the panel, at least one contact mounted on the panel, a hub connected to the rotating shaft and having a top and a first skirt integrally extending downward from the top with a positioning device, a pushbutton cap having a top and at least one second skirt corresponding to the positioning device on the first skirt on the hub to slide up and down the first skirt of the hub, wherein the at least one second skirt has a bottom edge on which a conductive are corresponding to the at least one contact is mounted, and a biasing member mounted in the pushbutton cap to provide a restitution force to the cap, wherein the pushbutton cap returns to an original position relative to the hub when pressure on the pushbutton cap is released and breaks contact between the at least one contact on the panel and the conductive arc.

9. The control device as claimed in claim 8 wherein the positioning device includes, multiple L-shaped resilience keys extending radially outward from said first skirt of said hub, wherein each key has a radial tab and a longitudinal leg; and multiple longitudinal recesses corresponding to the radial tabs of the keys are defined on an inside surface of said at least one second skirt of said pushbutton cap.

10. The control device as claimed in claim 8 wherein a tube having an inner face is integrally formed down from said top of said hub to hold said rotating shaft.

11. The control device as claimed in claim 8 wherein said pushbutton cap includes three different diameter concentric circular second skirts respectively formed on the top, wherein said conductive arc is mounted on the smallest diameter circular second skirt that is longer than the others to easily touch the contacts on said panel.

12. The control device as claimed in claim 8 wherein said biasing member is a spring mounted between said pushbutton cap and said hub.

* * * * *